United States Patent [19]

Phelps

[11] Patent Number: 4,474,457

[45] Date of Patent: Oct. 2, 1984

[54] PLATEN HAVING ANTI-STATIC PROPERTIES FOR USE WITH A DOCUMENT TRANSPORT SYSTEM

[75] Inventor: Russell L. Phelps, Penfield, N.Y.

[73] Assignee: Xerox Corporation, Stamford, Conn.

[21] Appl. No.: 420,989

[22] Filed: Sep. 21, 1982

[51] Int. Cl.[3] ..... G03G 15/00

[52] U.S. Cl. ..... 355/35 H; 355/75; 361/214

[58] Field of Search ..... 355/3 R, 35 H, 133, 355/75, 76, 48, 49; 361/212, 214, 220; 271/3, 3.1, 4

[56] References Cited

U.S. PATENT DOCUMENTS

| | | | |
|---|---|---|---|
| 3,094,436 | 6/1963 | Schröder | 361/212 X |
| 3,889,943 | 6/1975 | Krayer | 271/4 |
| 3,949,259 | 4/1976 | Kostlin et al. | 313/112 |
| 4,127,789 | 11/1978 | Kostlin et al. | 313/112 |
| 4,128,303 | 12/1978 | Onoki et al. | 350/164 |
| 4,171,128 | 10/1979 | Irvine et al. | 271/3 |
| 4,183,519 | 1/1980 | Harris | 271/245 |
| 4,213,603 | 7/1980 | Peffer et al. | 271/229 |
| 4,231,561 | 11/1980 | Kaneko et al. | 271/3.1 |
| 4,248,687 | 2/1981 | Fan | 204/192 P |
| 4,252,841 | 2/1981 | Kinugawa et al. | 427/108 |

FOREIGN PATENT DOCUMENTS

| | | |
|---|---|---|
| 55-65637 | 5/1980 | Japan . |
| 55-164838 | 12/1980 | Japan . |

*Primary Examiner*—R. L. Moses

[57] ABSTRACT

A document transport system for a copier has associated with it a platen having anti-static properties. A platen glass surface is coated with an optically transmissive grounded coating which serves to dissipate electrostatic fields which occur as a consequence of the movement of the document across the platen surface. In one embodiment wherein the transport system includes rollers which frictionally engage and move the document across the platen, the conductive coating is omitted in areas generally underlying the rollers.

4 Claims, 6 Drawing Figures

PLATEN HAVING ANTI-STATIC PROPERTIES FOR USE WITH A DOCUMENT TRANSPORT SYSTEM

BACKGROUND AND PRIOR ART STATEMENT

The present invention relates to a document transport system and, more particularly, to a document transport system with a document platen adapted to minimize drag forces associated with the movement of documents across its surface.

As demands for faster copying and printing machines have intensified, increasing attention has been given to improving the operation of the mechanisms used to feed original documents into an exposure area. The original documents are fed, either automatically (RDH systems) or semi-automatically (SADH systems) at speeds up to 35 inches/second onto a transparent copying window (platen). Whatever the transport system used, it must be capable of moving the documents from some initial position onto the platen, aligning and/or maintaining the document in the proper registration during exposure, and subsequently removing the document from the platen, without interfering with the transparency of the platen or the exposure of the document therethrough.

Various mechanisms are known in the art to transport the document into, and out of, a platen exposure area. U.S. Pat. Nos. 3,889,943 and 4,231,561 disclose arrangements wherein the documents are moved across the platen surface by flexible rotating belts overlying the platen. In U.S. Pat. Nos. 4,335,954, 4,213,603 and 4,171,128, for example, rollers are used to accomplish the same purpose. A problem with transport systems of the type disclosed in these references is that electrostatic forces associated with the movement of the paper across the platen are introduced. These forces create a "drag" on the transported document, resulting in misfeeding and especially misregistration problems. One solution to this problem is disclosed in Japanese laid-open publication No. 55-65637. As disclosed in this publication, documents to be copied are transported to the top of a platen by a conveyor belt mechanism. The surface of the glass platen is coated with an optically transmissive conductive material grounded through a series of rollers. This arrangement acts to dissipate the static charges which accumulate during frictional transport of the document across the platen. While this arrangement may be suitable for the document size conveyor belt used in the disclosed system, it has been found that systems using more localized document transport systems; e.g. rollers, experience a continued electrostatic drag force in those areas underlying the localized transprent mechanism. The present invention is therefore directed to an improved transport system which includes a glass platen selectively modified to incorporate anti-static and improved optical properties. More particularly, the invention is directed to a document transport system wherein localized document transport means are positioned in operative frictional engagement with a document so as to move said document into a registration position prior to exposure and to remove said documents from said platen following exposure, an improved platen comprising a glass base coated with at least a layer of grounded, optically transmissive, conductive material, said conductive material being omitted in an area generally underlying the frictional contact area of said localized transport means.

DRAWINGS

DESCRIPTION

Figure 1:
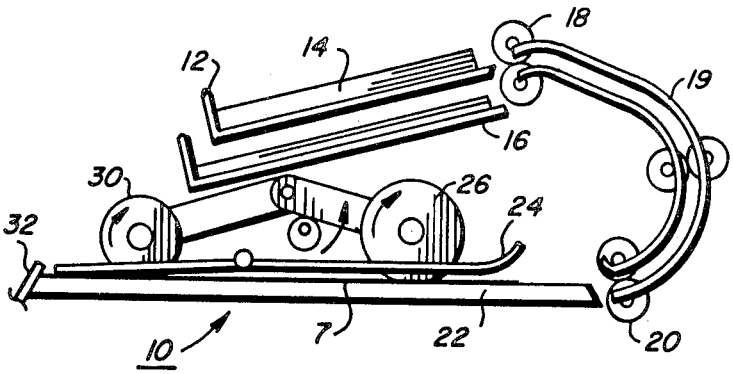
FIG. 1 PRIOR ART
FIG. 1 is a partial side view of a prior art document transport system.
Figure 2:
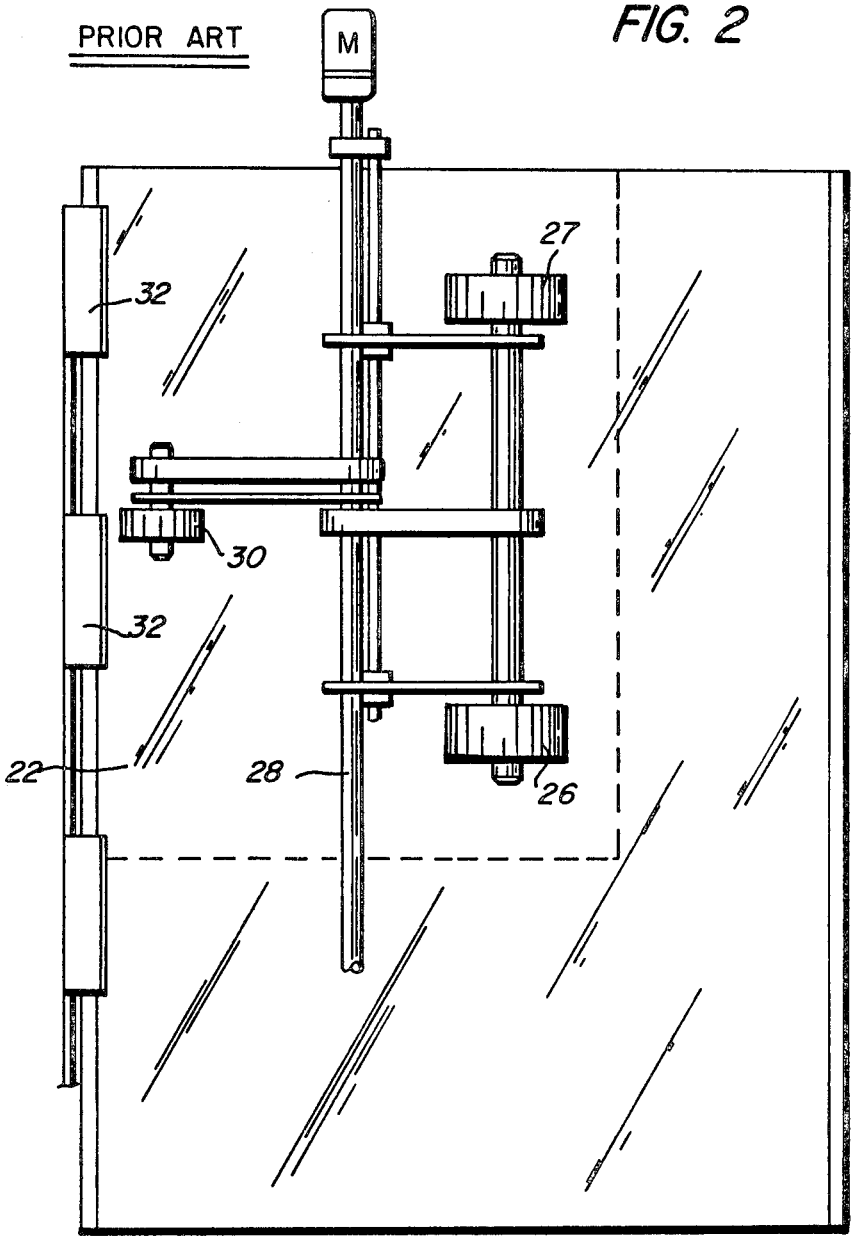
PRIOR ART FIG. 2
FIG. 2 is a partial plan (top) view of the system of FIG. 1.

An exemplary document sheet handling system in which the improved platen according to the present invention may be utilized as shown in FIGS. 1 and 2. The initial description of this system emphasizes that portion of the document handling transport mechanism which moves the document onto and off the platen area, but that is not claimed herein. For a fuller description of the transport system, reference is made to copending Application Ser. No. 404,254 filed Aug. 2, 1982 by Russell L. Phelps, et al. and assigned to the same assignee as the present invention, and whose contents are hereby incorporated by reference.

Referring to FIGS. 1 and 2 a document sheet handling system 10 includes a document tray 12 for supporting a stacked set of individual document sheets 14 which are to be copied. The documents are fed out of the bottom of the stack by the action of vacuum belt system 16 and roller pair 18. The bottom document is fed by rollers 18 along guide edge 19 into a nip formed by a feed roll set 20 and thence onto the surface of platen 22. As the lead edge of a document sheet passes beneath document clamp 24 it is first engaged by a pair of document sheet feed rollers 26, 27 commonly driven, via a common axis drive shaft 28, from motor M. Rollers 26, 27 which have high friction surfaces designed to reduce document skewing, control the passage of the document sheet across the platen until the leading edge reaches roller 30 at which time rollers 26, 27 are cammed upwardly by means not shown and roller 30 accomplishes final document sheet deskewing registration against registration edge 32. During exposure of the document (by a flash illumination system not shown) document clamp 24 is lowered so as to flatten the document sheet against the platen. Following exposure, the registration edge 32 is retracted, clamp 24 is raised and roller pair 26 lowered. The document is then driven off the platen by rollers 26 and 30 and the next document is moved into the exposure position.

As seen from the above description, and as especially evident from FIG. 2, the document is in sliding contact with the portion of the platen extending from the right (input) side of the platen into the nip of rollers 26. From rollers 26 through to the left (output) edge of the platen, the sheet is in what can be described as a sliding/frictional contact with the platen surface. This sheet-to-platen contact gives rise to an electrostatic tacking force wherein the document sheet tends to be electrostatically tacked to the platen glass surface due to the charge differences between paper and glass. The standard platen glass is a soda lime float glass with a surface resistivity of $10^{12}$ to $10^{15}$ ohm/sq while the document sheet resistivity may vary from $10^{10}$ to $10^{15}$ ohm/sq. While there is a wide range of possible sheet and glass combinations, electrostatic fields of up to $+5$ V/μm on the platen glass and $-2$ V/μm on the document sheet are possible. As a general proposition therefor, the charge polarities can be characterized as paper negative and glass positive with a positive field left on the platen following sheet removal. These charge polarity relationships create an electrostatic tacking force along the platen surface which exerts a drag on the documents resulting in possible sheet misregistration. This residual field on the platen surface will normally decay by 90% after approximately 18 seconds with normal humidity, which is, much too long, of course, to permit high speed document transport operation. These electrostatic fields tend to increase with increased sheet feeding across the platen; hence the drag problem becomes cumulatively worse.

Figure 3:
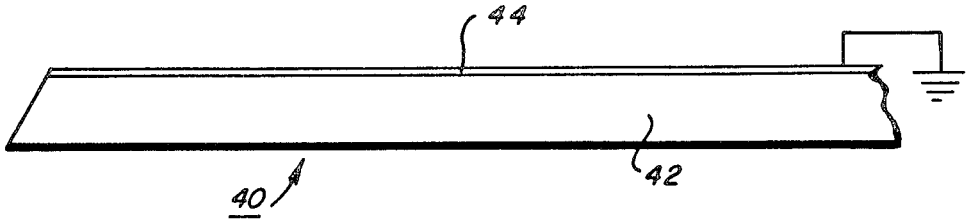
FIG. 3 is a first embodiment of an anti-static platen according to the invention wherein the platen has a transparent conductive overcoating.

It is known that reduction of the charge levels at either of the two interacting elements (document or glass) reduces the electrostatic drag forces. The charge level is a formation of two primary variables; (1) the triboelectric relationship between the document and the glass and (2) the conductivity of the platen surface and the document. As to the first variable, it is an extremely difficult task to triboelectrically match the platen glass and document sheet due to the uncontrollable variables present in the documents to be copied. As to the second variable, the document sheet properties are again not subject to control but, as applicants have perceived, the platen surface resistivity is, in principle, controllable. Application of a grounded conductive coating to the surface of the platen would, in theory, provide a rapid surface charge bleedoff, thereby dissipating the electrostatic drag fields. Conductive coatings however, generally contain a metal, or a metal oxide, the presence of the metal adversely affecting the optical transmission of the platen. A conductive platen coating which has the desired conductivity and which provides the desired optical transmission properties is disclosed in FIG. 3. As shown in FIG. 3, a platen 40 comprises a glass support layer 42 of a 0.6 cm thick PPG glass having a grounded overcoating 44 of conductive indium tin oxide. (The thickness of coating 44 has been exaggerated for descriptive purposes.) Coating 44, in a preferred embodiment has a surface resistivity of $10^6$ ohms/sq in 70° F. and 50% RH. The coating is applied to a thickness of 50 Å. Electrostatic field dissipation of 50% to 100% should be accomplished in $<70$ milliseconds.

Figure 4:
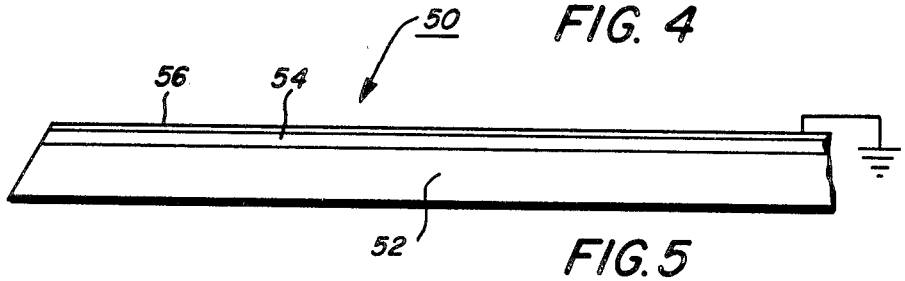
FIG. 4 is a second embodiment of an anti-static platen according to the invention wherein the platen has a layer of Mg resin fluoride between the platen glass and a transparent conductive layer.

A second embodiment of the platen is shown in FIG. 4. In this embodiment, platen 50 comprises PPG glass support layer 52, having a 90.5 Å thick layer 54 of Magnesium Fluoride (MgF2) overcoated with a grounded 50 Å layer 56 of indium tin oxide. In this embodiment, the reflectance properties are improved by the addition of the MgF2 layer. This glass layer 52 has a reflectance of 5% at 550 nm, which may be optically unacceptable for certain systems. MgF2, with its 1.4 refractive index, provides a reflectance of 2% at 550 nm. It is noted that the glass MgF2 construction alone would experience even more severe problems with the aforementioned electrostatic tacking forces. MgF2 has a resistivity of $10^{14}$–$10^{16}$ ohms/sq and a charge dissipation scale of 120 seconds, orders of magnitude higher than even the plain glass.

While the provision of adding the grounded conductive tin oxide coating to the platen surfaces shown in FIGS. 3 and 4 reduces or completely eliminates the drag problem associated with the movement of documents across the platen surface in the sheet feeding mode, there remains a further problem associated with feed systems such as that shown in FIGS. 1 and 2. Referring to these figures, it is seen that rollers 26, 27, 30 as they rotate, produce highly localized, frictional contact between the document sheet and the platen. Because of the presence of conductive coating 44, triboelectric charging occurs very rapidly resulting in localized fields under the drive nips of from 2 to 10 times higher than the forces under remainder of the platen surface resulting from document-to-glass contact. Since these fields are directly proportional to the electrostatic drag forces (drag force (grams) charge/area) the result, for the FIGS. 1, 2 configuration, is that those areas concentrated under and spreading out slightly from the roller contact areas are at constantly higher charge levels then the remainder of the platen. While the conductive layer dissipates these localized charge regions following removal of the document, it was unexpectedly discovered that the presence of these fields during the real time positioning of the document for exposure, i.e. during one sheet pass; may be sufficient to create a sufficient drag force on the document so as to result in either a skewed document misregistration and/or a misregistration caused by the document being prematurely slowed and stopped short of the final registration position.

A second problem associated with the roller system of FIGS. 1, 2 and the FIG. 4 platen embodiment is that over an extended time cycle, the indium tin oxide layer becomes worn away, exposing the underlying MgF2 layer and introducing the higher decay times associated with this surface.

Figure 5:
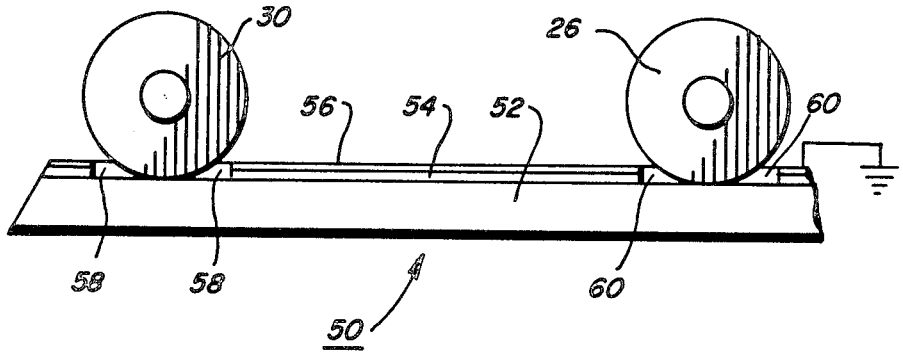
FIG. 5 is a modification of the FIG. 4 embodiment wherein selected portions of the platen's conductive overcoating are removed.
Figure 6:
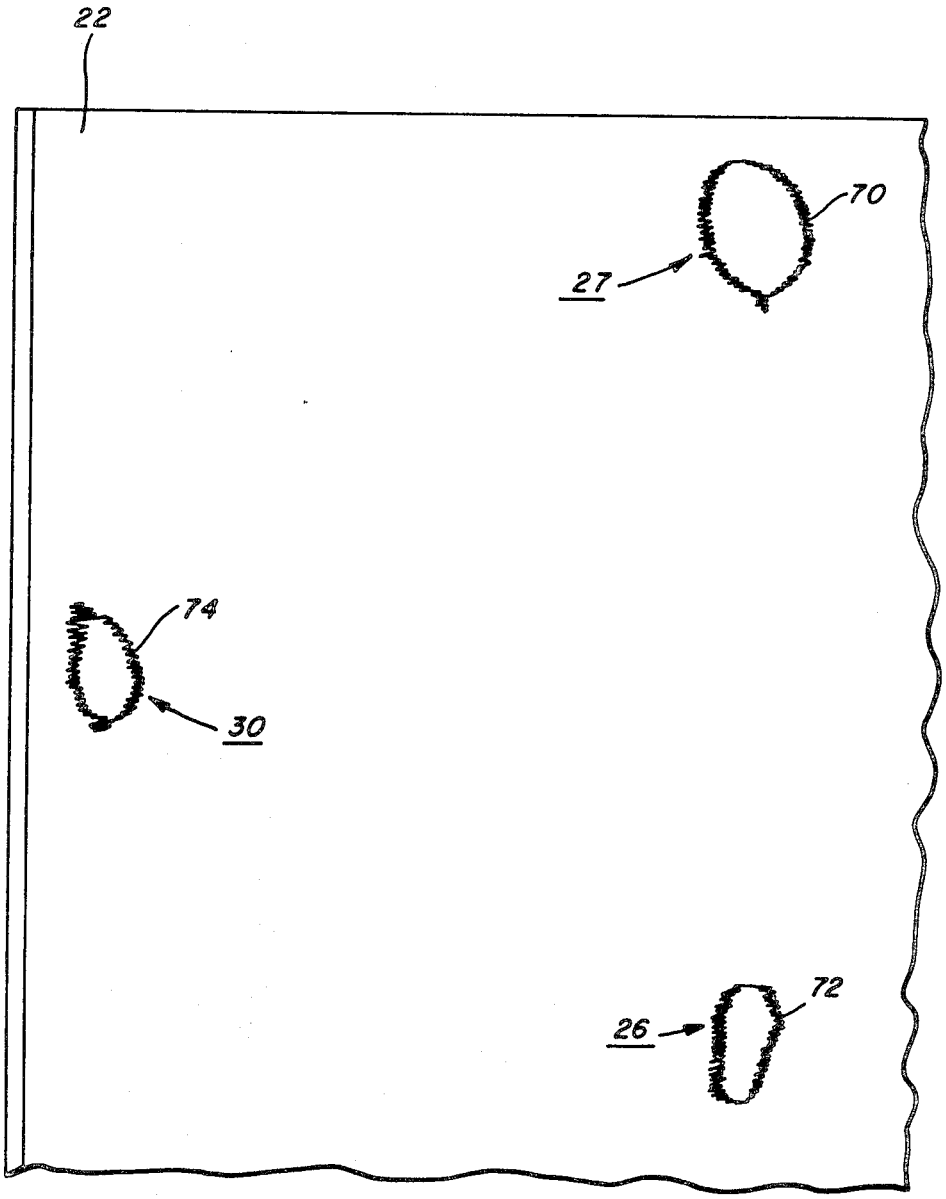
FIG. 6 is a representation of the platen surface showing charge areas resulting from frictional contact between document and platen glass resulting from localized frictional document transport mechanisms.

According to the present invention, applicant has solved the above described, localized, frictional problem by removing the coating or coatings from an area generally underlying the roller contact surfaces. As shown in FIG. 5, the platen shown in FIG. 4 has been modified by removing portions of layer 54 and 56 generally underlying rollers 26, 27, 28 leaving "windows" 58, 59, (not visible), 60. This removal may be accomplished by a polishing process that removes the coatings at each drive nip, or by suitable masking techniques. The exact areas to be removed may be identified by a photographic process wherein a highly sensitive film is taped to the bottom of the platen of the machine to be modified. A certain number of documents are moved across the platen and then the film is then removed and processed. The film will show the position and general size of the visible light "arc discharge" that occurs as the document sheet leaves the platen. FIG. 6 represents a film made for the roller system of FIG. 2 and the platen of FIG. 4. As shown in FIG. 6, the charge fields generally correspond to areas underlying rollers 26, 27 and 30. Charge area 70, corresponds to roller 27, area 72 to roller 26 and area 74 to roller 30. As shown, the charge fields do not correspond exactly to the frictional contact area of the rollers. Fields 72, 74 are spread in a lateral direction while field 70 assumes a more circular configuration. The removed portion of the layers coated on the platen glass should thus conform as much as possible to the actual charge field of each individual field.

The embodiment disclosed herein is intended to improve the registration of documents transported across a platen by a roller type transport system. It will be appreciated that these embodiments are merely exemplary and that other variations, modifications or alternative embodiments may be made by those skilled in the art from this teaching. For example, while the invention is effectively used in a roller transport system, may also be used in other types of document transport systems using localized transport means such as frictional pads or narrow belts. While the conductive platen coating is indium tin oxide, other optically transmissive conducting coatings. These alternate embodiments are intended to be encompassed by the following claims.

What is claimed is:

1. In a document transport system wherein localized document transport means are positioned in operative frictional engagement with a document overlying a platen so as to move said document into an exposure position and to remove said document from said platen following exposure, an improved platen comprising a glass base coated with at least a layer of grounded, optically transmissive, conductive material, said conductive material being omitted in an area generally underlying the frictional contact area of said localized transport means.

2. The document transport system of claim 1 wherein said conductive material is a 50 Å coating of indium tin oxide.

3. The document transport system of claim 2 wherein said platen has a layer of magnesium fluoride between said glass base and said conductive layer, the magnesium fluoride also being eliminated in areas conforming to omitted areas of the conductive material.

4. The document transport system of claim 1 wherein said localized transport system comprises a plurality of rollers.

* * * * *